US010730650B2

(12) United States Patent
Curcó Masip et al.

(10) Patent No.: US 10,730,650 B2
(45) Date of Patent: Aug. 4, 2020

(54) PRODUCT DISCHARGE CONTROL DEVICE FOR A FORM-FILL-SEAL MACHINE

(71) Applicant: PAYPER, S.A., Lleida (ES)

(72) Inventors: Carmelo Curcó Masip, Lleida (ES); Gil Bonet Rosell, Lleida (ES)

(73) Assignee: PAYPER, S.A., Lleida (ES)

( * ) Notice: Subject to any disclaimer, the term of this patent is extended or adjusted under 35 U.S.C. 154(b) by 151 days.

(21) Appl. No.: 15/820,956

(22) Filed: Nov. 22, 2017

(65) Prior Publication Data

US 2018/0141690 A1 May 24, 2018

(30) Foreign Application Priority Data

Nov. 22, 2016 (EP) ..... 16382544

(51) Int. Cl.

| | |
|---|---|
| ***B65B 39/00*** | (2006.01) |
| ***B65B 43/00*** | (2006.01) |
| ***B65B 1/30*** | (2006.01) |
| ***B65B 1/06*** | (2006.01) |
| ***B65B 9/10*** | (2006.01) |
| ***B65B 37/02*** | (2006.01) |
| ***B65B 37/18*** | (2006.01) |

(52) U.S. Cl.

CPC ..... *B65B 39/002* (2013.01); *B65B 1/06* (2013.01); *B65B 1/30* (2013.01); *B65B 9/10* (2013.01); *B65B 37/02* (2013.01); *B65B 37/18* (2013.01); *B65B 43/00* (2013.01)

(58) Field of Classification Search

CPC ..... B65B 39/00; B65B 39/002; B65B 39/007
USPC ..... 53/551, 574, 576, 235; 141/10
See application file for complete search history.

(56) References Cited

U.S. PATENT DOCUMENTS 4,791,776 A * 12/1988 Jackman ..... B65B 1/06 141/10
5,168,906 A 12/1992 Combrink
7,855,343 B2 * 12/2010 Nakagawa ..... B65B 37/18 177/25.18

(Continued)

FOREIGN PATENT DOCUMENTS

| | | |
|---|---|---|
| EP | 1956351 A1 | 8/2008 |
| EP | 2843379 A1 | 3/2015 |
| ES | 2334474 A1 | 3/2010 |

OTHER PUBLICATIONS

European Search Report dated May 10, 2017, from corresponding European Patent Application No. 16382544.1.

*Primary Examiner* — Gloria R Weeks
(74) *Attorney, Agent, or Firm* — Katten Muchin Rosenman LLP

(57) ABSTRACT

The invention relates to a discharge control device, comprising a hopper (1) receiving a metered product amount where it is deposited, discharge control elements (3) movable between a closed position and an open position by a driving mechanism, and a fill tube (2) connecting the discharge control device with a fill nozzle of the form-fill-seal machine whereby a bag is filled with product, wherein the driving mechanism of the discharge control elements (3) comprise a motor (7) driving the movement of one of the discharge control elements (3), and a synchronizing connecting rod (9) synchronizing the movement of the discharge control element (3) driven by the motor (7) with the other discharge control element (3). The invention allows filling bags reliably and more quickly.

8 Claims, 4 Drawing Sheets

(56) References Cited

U.S. PATENT DOCUMENTS

| | | | | |
|---|---|---|---|---|
| 8,776,485 | B2 * | 7/2014 | Nishitsuji | B65B 31/045 53/450 |
| 2012/0198799 | A1 * | 8/2012 | Nishitsuji | B65B 31/045 53/551 |
| 2014/0109513 | A1 * | 4/2014 | Van Rens | B29C 65/02 53/285 |
| 2016/0214751 | A1 * | 7/2016 | Kawata | B65D 88/66 |
| 2019/0084700 | A1 * | 3/2019 | Kieselhorst | G01G 13/006 |

* cited by examiner

PRODUCT DISCHARGE CONTROL DEVICE FOR A FORM-FILL-SEAL MACHINE

The present invention relates to a product discharge control device for a form-fill-seal machine which allows filling bags reliably and more quickly.

BACKGROUND OF THE INVENTION

Form-fill-seal machines, referred to as FFS machines, using a tubular reel of plastic material are known, and the process starts from a tubular reel for forming a bag having a given length, which bag is filled with a product and is closed or sealed once it is filled.

One of the most important work stations in this process is the fill station, in which the bag previously formed in a previous station and transferred to the fill station by conveyance means is opened at the upper part to allow the bag fill nozzle to enter the bag and discharge the product that has been prepared upstream from the bag fill nozzle through the passage formed by blades of the nozzle as they open.

In this station, the bag is filled with the metered product amount by means of using a discharge device located upstream from the bag fill nozzle, which allows reducing the total time required to perform this filling and to thereby obtain the maximum working speed of the form-fill-seal machine, since the faster the product discharge into the bag is, the lower the work cycle of this station, and accordingly, the higher the working speed, and therefore, the higher the production capacity of the form-fill-seal machine.

The device typically used to discharge the product into the bag is called a gravity discharge tube, or a gravity acceleration tube. Examples of tubes of this type are shown, for example, in patent documents ES 2,334,474 and U.S. Pat. No. 5,168,906.

One of the drawbacks of using these discharge devices, using either a system for regulation by means of a cone system or else using a system for regulating discharge by means of a discharge blade system, is that the discharge is done directly of from the weighing unit (which weighs, meters and isolates the amount of product to be used for filling the bag) onto the discharge control device in the form-fill-seal machine and in synchronicity with the placement of the empty bag in the bag fill nozzle (with an advanced positioning of the discharge to optimize the moment of arrival of the product to the bag fill nozzle).

The fact that there is a coupling at the time of product discharge between both the weighing unit and the form-fill-seal machine means that at high working speeds one of them may condition the other and therefore mutually slow one another down due to synchronism.

A solution for decoupling both systems and improving the working speed at high speeds is for the discharge device to allow decoupling both machines from one another.

An improvement to the material discharge devices existing on the market basically consists of a gravity discharge tube, the distinguishing feature of which compared to the cone or the blades controlling the product discharge is that instead of being kept in a preferably open setting adapted to the maximum flow that can be unloaded towards the fill nozzle, they have the improved feature of being completely closed when they receive the discharge from the weighing unit, not allowing any product flow downstream.

Only when the form-fill-seal machine requests that the product be discharged is this discharge gate (in the form of a cone or blades) opened to allow product discharge from the hopper. This means that as soon as the weighing unit has discharged the product in the discharge control system downstream, a metering and weighing cycle starts up again regardless of the status of the form-fill-seal machine, and in the same manner, if there were a product discharge prepared in the discharge control device, this discharge can be done at the request of the form-fill-seal machine, even if the weighing unit has not finished preparing a new metered product amount.

The gates of the product discharge device are opened and closed by means of a pneumatic-type drive, so by means of adjustment mechanisms the optimal discharge opening can be regulated so as to obtain the minimum discharge time which thus allows maximizing the working speed of the form-fill-seal machine. This solution has some drawbacks: on one hand, the use of these devices controlled by pneumatic driving means for effecting the movements of the discharge blades has a limitation in controlling the opening and closing speeds, because the sudden stops upon reaching the end positions of the drives cause vibrations and collisions (particularly when closing the blades on the discharge opening), limiting in practice the maximum working speed of this device.

On the other hand, the fact that the pneumatic control positions are fixed, or improving the fact that the position of the opening thereof is adjustable by means of mechanical regulating systems, limit the application thereof when trying to optimally adjust the device for different products, so the format change or adaptation of the open position of the discharge gates will be done by hand.

This regulation of the open position can be automated, but with a system for automatically positioning the opening stop, two basic drawbacks would remain unsolved: the limitation to the opening/closing speeds of the blades of the discharge devices, and the possibility of optimizing the discharge cycle by means of positioning the discharge blades in different positions during product discharge for the purpose of minimizing the total discharge time, for example, with a first opening for maximizing the discharge, while the outlet opening is filled with product, and a second position to finish discharging the residue when the product slides down over the actual surface of the discharge blades.

Therefore, the purpose of the present invention is to overcome the limitations existing in the current state of the art of devices which, controlled by pneumatic drives, do not allow working with high opening/closing speeds of the blades of the product discharge device in a product discharge control device with the required reliability, for example, at form-fill-seal speeds of about 2,400 to 2,750 cycles per hour.

DESCRIPTION OF THE INVENTION

The discharge control device solves the aforementioned drawbacks and has other advantages that will be described below.

The product discharge control device for a form-fill-seal machine according to the present invention is defined in independent claim 1. Other optional features are described in the dependent claims.

Specifically, the product discharge control device for a form-fill-seal machine according to the present invention comprises a hopper receiving the discharge of a predetermined metered product amount used for filling the bag downstream in the fill nozzle of the form-fill-seal machine, which also comprises a discharge nozzle through which the metered product amount is discharged downstream in a controlled manner by means of control elements movable between a closed position and an open position by driving means, and characterized in that said driving means comprise first and second levers, each integral with one of said discharge control elements, said levers being connected at one of their ends to a common synchronizing connecting rod, synchronizing the opening and closing movements of both discharge control elements.

This discharge device is preferably driven by means of using a motor the output shaft of which is coupled to a mechanism comprising a second connecting rod and a crank, which second connecting rod is attached to the end of one of the two levers, integral with one of the two discharge control elements, transmitting the movement of the motor through the described kinematic chain. The second of the levers integral with the other discharge control element is driven by means of the synchronizing connecting rod attaching them to one another.

As a result of these features, both the speed of the product discharge control elements and the position thereof during the discharge cycle can be controlled in an optimal manner, resulting in a shorter discharge time for discharging metered product amount through the fill tube connecting the described discharge device with the bag fill nozzle of the form-fill-seal machine located downstream. The reduction of this discharge time is what allows obtaining shorter work cycle times of the form-fill-seal machine and increasing the working speed thereof. Furthermore, the fact that the device is provided with a motorized drive allows making specific adjustments to the discharge control means for each product, metered fill amount and type of bag fill nozzle located downstream, without having to make mechanical adjustments to the system, only by means of the parameterization of opening positions and speeds of the control system of the motor, resulting in a reduction of the required adjustment times in the case of having to make a change in the product to be packaged or a change in the value of the metered fill amount.

Advantageously, and in a preferred embodiment of the invention, when the discharge control elements are in the closed position, the drive mechanism of the second connecting rod and the crank is located in a dead center position, i.e., in the position defined by the kinematics of this mechanism, in which an increase in rotation of the crank in the same direction makes the second connecting rod move in the direction opposite the one in which it was moving up until this time, which allows adjusting the position of the discharge control elements on the discharge hopper outlet profile, without any collisions occurring at the closing point, since the actual mechanism of the second connecting rod and the crank limits the maximum angular position the discharge control elements reach with respect to the discharge hopper outlet profile. Furthermore, this embodiment has the advantage that in the described closed position, the mechanism of the second connecting rod and crank located in this dead center position is irreversible or locked in place against external forces, in this case caused by the product impacting against the discharge control elements in the closed position thereof. This results in greater reliability and robustness of the control device, preventing the possible opening of the discharge control elements due to the impact of the metered product amount discharged upstream by the weighing unit in this closed position.

Advantageously, said open position of said discharge control elements can be regulated, for example, with an angle of opening comprised between 50° and 90°, and furthermore, said discharge control elements are also movable during the discharge cycle to a regulating position, in which the angle of opening is increased to make it easier to discharge all of the product from inside the hopper.

Advantageously, the motorized driving means comprise the use of a servomotor, because it allows effecting in a controlled parameterizable manner both the positions and the speeds of the control elements during the discharge cycle.

According to two alternative embodiments, said discharge control elements are swinging blades.

BRIEF DESCRIPTION OF THE DRAWINGS

To better understand the preceding description, a set of drawings is attached in which a practical embodiment is schematically depicted by way of non-limiting example.

DESCRIPTION OF A PREFERRED EMBODIMENT

Figure 1:
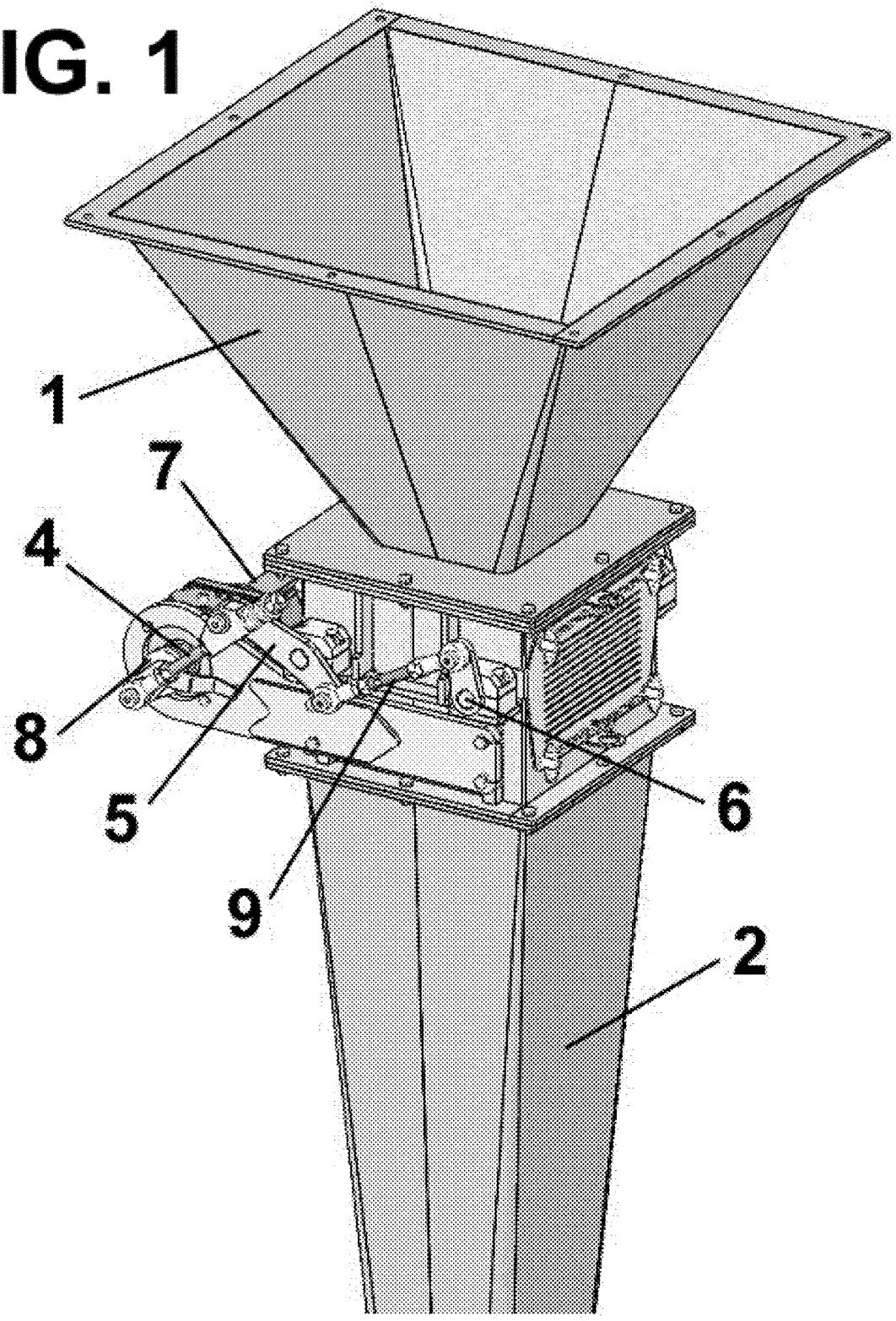
FIG. 1 is a perspective view of the product discharge control device according to the present invention.

The drawings depict the product discharge control device according to the present invention, comprising a hopper 1 where the metered product amount used for filling the bag is discharged and a fill tube 2, connecting the discharge control device according to the present invention to the fill nozzle of the form-fill-seal machine.

The control device according to the present invention also comprises discharge control elements 3 that are movable between an open position in which product discharge is allowed, and a closed position in which product discharge is prevented, which allows receiving in this closed position a new metered product amount discharge released by the metering and weighing system located upstream.

Said discharge control elements 3 are arranged between the hopper 1 and the fill tube 2, as seen in the drawings, and allow controlling product discharge towards the fill nozzle of the form-fill-seal machine.

According to the depicted embodiment, said discharge control elements 3 are swinging blades, although they could be any suitable discharge control element that is equivalent in terms of function.

The driving means which allow the movement of said discharge control elements 3 comprise a connecting rod-crank mechanism that will be described below, driven by means of a motor 7, for example, by means of a servomotor.

Said connecting rod-crank mechanism comprises a crank 8 connected to the output shaft of the motor 7 and a second connecting rod 4 connected thereto at one of its ends. The other opposite end of this second connecting rod 4 is in turn connected to one of the ends of the lever 5 integral with the rotating shaft of one of the discharge control elements 3. The rotational movement of the first lever 5 is transmitted to the second lever 6, which is integral with the rotating shaft of the second of the discharge control elements 3, in a synchronous manner by means of the synchronizing connecting rod 9.

Advantageously, when the discharge control elements 3 are in the closed position, said crank 8 and said connecting rod second 4 are in a dead center position, i.e., in the position defined by the kinematics of this mechanism, in which an increase in rotation of the crank 8 in the same direction makes the second connecting rod 4 move in the direction opposite the one in which it was moving up until this time, which allows adjusting the position of the discharge control elements on the discharge hopper outlet profile, without any collisions occurring at the closing point, since the connecting rod-crank mechanism itself limits the maximum angular position the discharge control elements 3 reach with respect to the discharge hopper outlet profile.

It should be indicated that the discharge control elements 3 can also be placed in different positions of the angle defined by said discharge control elements 3 during the product discharge cycle to obtain the shortest discharge time of all the product contents. Said positions of the discharge control elements can be fixed during the entire discharge cycle, or they can be variable and controlled by the automaton effecting discharge control during this cycle.

Figure 2:
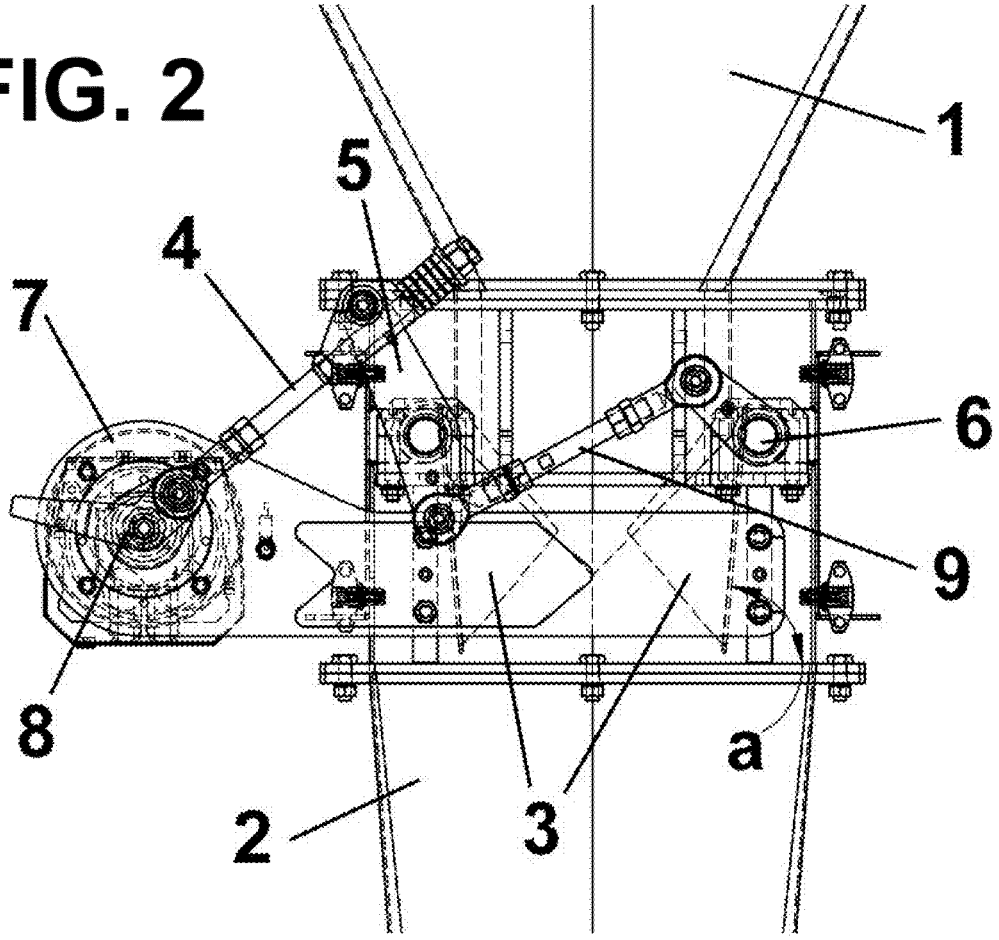
FIGS. 2 and 3 are elevational views of the product discharge control device according to the present invention in the open position and in the closed position of the discharge control elements.
Figure 3:
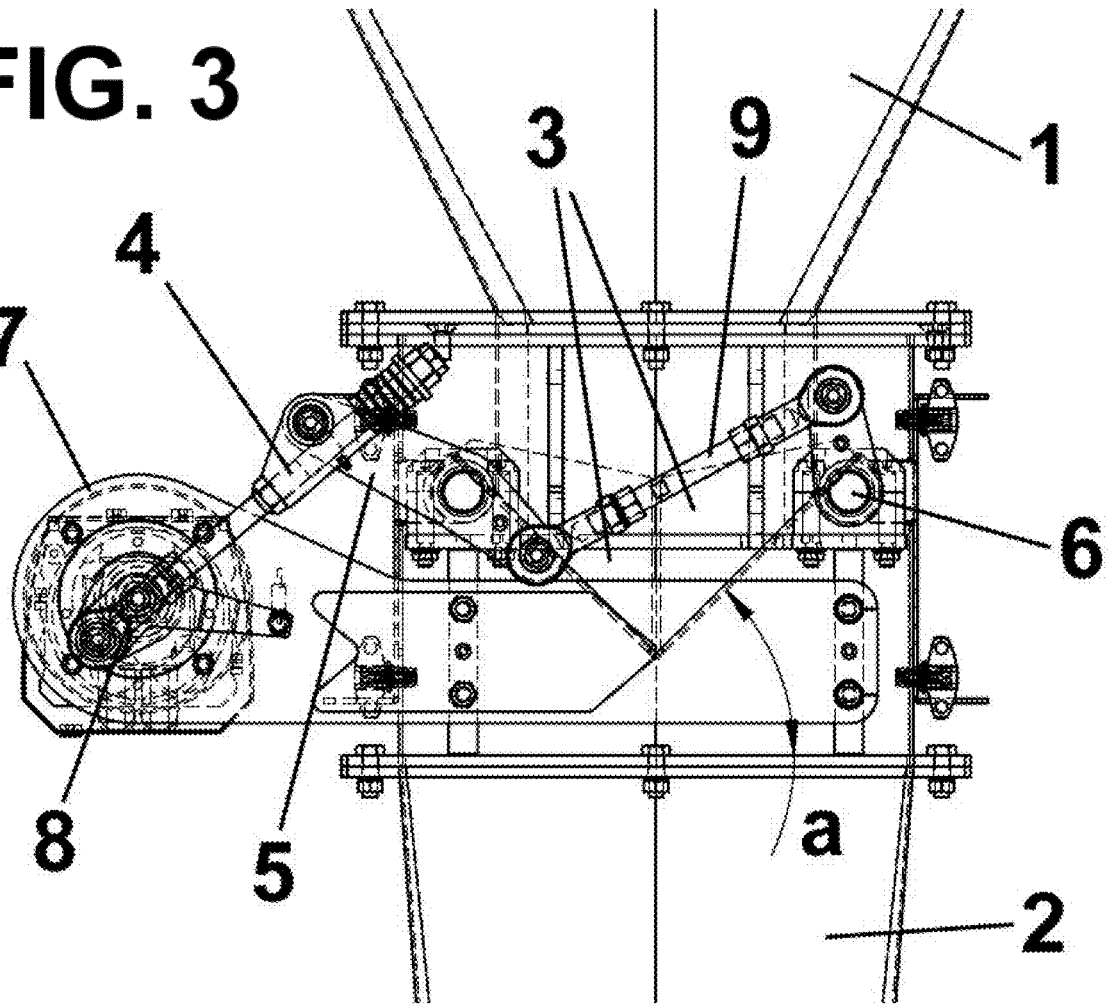

Preferably, the angle defined by said discharge control elements 3 with respect to the horizontal, indicated in FIGS. 2 and 3 by means of the letter "a", is preferably comprised between 50° and 90°.

The operation of the discharge control device according to the present invention is as described below.

In the closed position, in the dead center position of the connecting rod-crank mechanism, the hopper 1 is filled with the metered product amount to be filled or discharged into the bag.

In this closed position of the discharge control elements 3, the product is retained in the hopper 1, preventing it from being passed on to the fill tube 2.

When the form-fill-seal machine located downstream gives the discharge order, the discharge control elements 3 move following the opening cycle pre-established by the control system for discharging the metered product amount in a controlled manner.

The movement of the discharge control elements 3 is achieved by means of driving the connecting rod-crank mechanism described above by means of the motor 7.

Once the desired product amount has been discharged, the discharge control elements 3 move to the closed position following the closing cycle pre-established by the control system, also by means of the connecting rod-crank mechanism and the motor 7.

The angular movement trajectory (angular positions and speeds) of the discharge control elements during the opening and closing cycle can be programmed and/or adjusted by means of the control automaton for the purpose of obtaining the shortest time for the complete metered product amount discharge.

Then from the closed position of the discharge control elements 3, the cycle is repeated again as soon as the device receives a new metered product amount, and the form-fill-seal machine requests a new discharge.

The cycle described above is obviously performed continuously, many times at a high speed.

Figure 4:
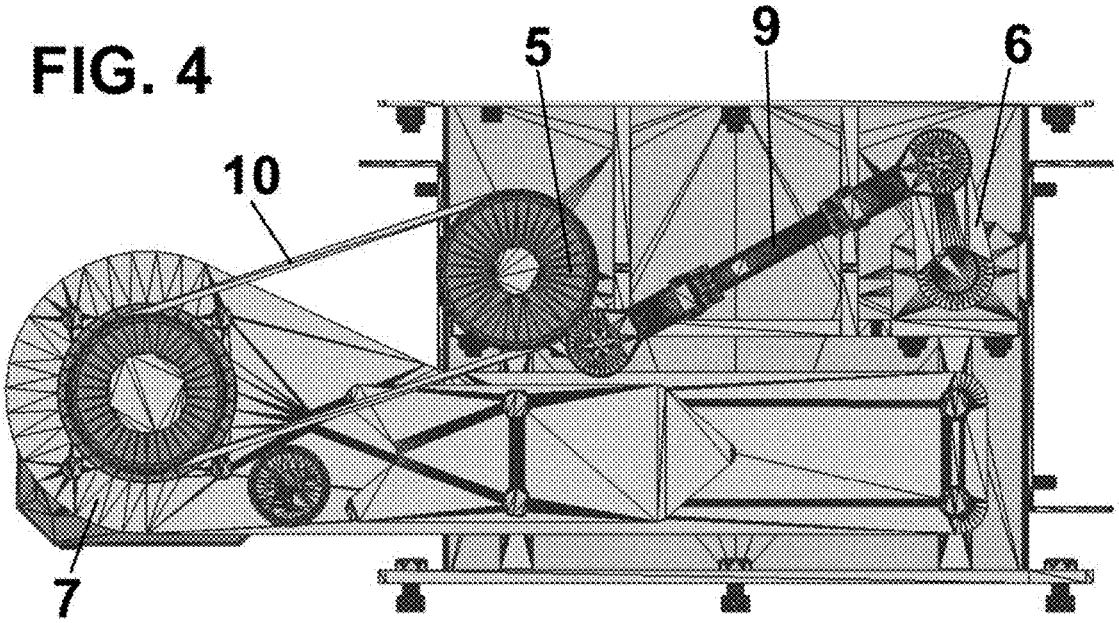
FIG. 4 is an elevational view of the driving means of the product discharge control device of the present invention according to a second embodiment.

FIG. 4 shows a second embodiment of the discharge control device according to the present invention.

For the sake of simplicity, the same reference numbers are used to indicate elements equivalent to the preceding embodiment. It should furthermore be indicated that only the driving means of the discharge control elements are different in this embodiment, the remaining elements being the same as in the first embodiment.

In this embodiment, the driving means of the discharge control elements also comprise first and second levers 5, 6 connected by means of said synchronizing connecting rod 9, each integral with a shaft for moving each of said discharge control elements 3, and the movement of which is driven by means of a drive belt 10 located between the output shaft of the motor 7, preferably a servomotor, and one of said levers 5, 6.

Figure 5:
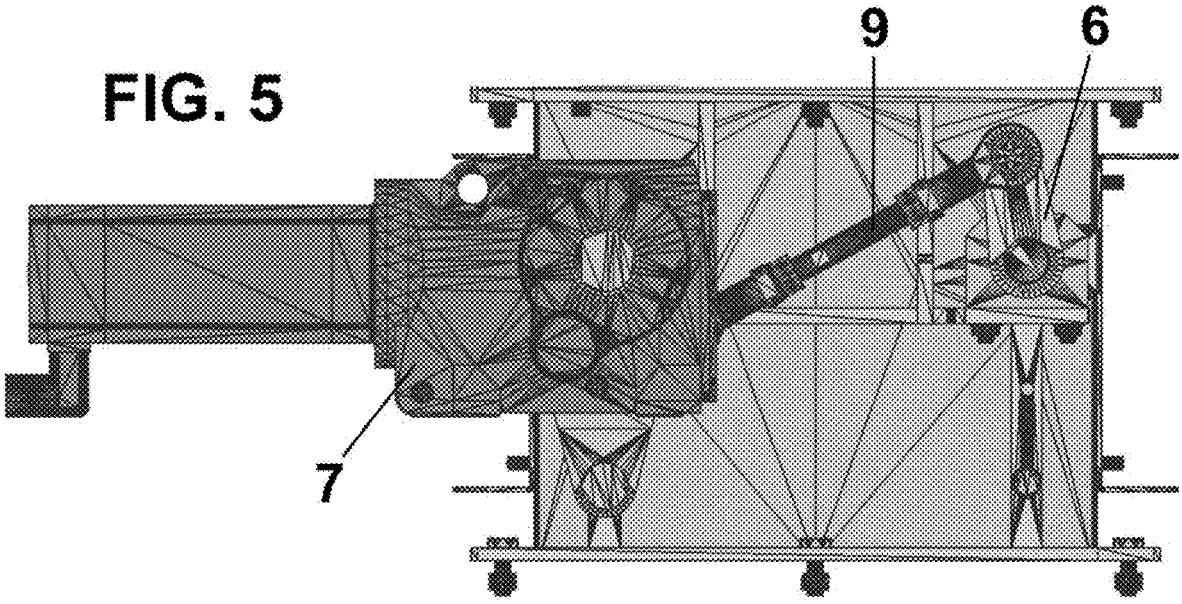
FIG. 5 is an elevational view of the driving means of the product discharge control device of the present invention according to a third embodiment.

FIG. 5 shows a third embodiment of the discharge control device according to the present invention.

Like in the preceding case, for the sake of simplicity, the same reference numbers are used to indicate elements equivalent to the preceding embodiments. It should furthermore be indicated that only the driving means of the discharge control elements are different in this embodiment, the remaining elements being the same as in the first and second embodiments.

In this third embodiment, the driving means also comprise first and second levers 5, 6 connected by means of said synchronizing connecting rod 9, each integral with a shaft for moving each of said discharge control elements 3, and the movement of which is driven by means of the output shaft of the motor 7 directly driving one of said levers 5, 6.

Although reference has been made to a specific embodiment of the invention, it is obvious for a person skilled in the art that the discharge control device described is susceptible to a number of variations and modifications and that all the mentioned details can be replaced with other technically equivalent ones without departing from the scope of protection defined by the attached claims.

The invention claimed is:

1. Product discharge control device for a form-fill-seal machine, comprising a hopper (1) receiving a metered product amount where it is deposited, discharge control elements (3) movable between a closed position and an open position by a driving means, and a fill tube (2) connecting the discharge control device with a fill nozzle of the form-fill-seal machine whereby a bag is filled with product, characterized in that the driving means of the discharge control elements (3) comprise a motor (7) driving the movement of one of the discharge control elements (3), and a synchronizing connecting rod (9) synchronizing the movement of the discharge control element (3) driven by the motor (7) with the other discharge control element (3), wherein said driving means also comprise first and second levers (5, 6) connected by means of said synchronizing connecting rod (9), each integral with a shaft for moving each of said discharge control elements (3), and the movement of which is driven by means of a drive belt (10) located between the output shaft of the motor (7) and one of said levers (5, 6).

2. Product discharge control device for a form-fill-seal machine according to claim 1, wherein said driving means also comprise first and second levers (5, 6) connected by means of said synchronizing connecting rod (9), each integral with a shaft for moving each of said discharge control elements (3), and the movement of which is driven by means of a second connecting rod (4) and a crank (4, 8).

3. Product discharge control device for a form-fill-seal machine according to claim 2, wherein the crank (8) is connected to the output shaft of a drive motor (7).

4. Product discharge control device for a form-fill-seal machine according to claim 1, wherein when the discharge control elements (3) are in the closed position, said crank (8) and said second connecting rod (4) are in a dead center position.

5. Product discharge control device for a form-fill-seal machine according to claim 1, wherein said open position of said discharge control elements (3) has an angle of opening comprised between 50° and 90°.

6. Product discharge control device for a form-fill-seal machine according to claim 1, wherein said discharge control elements (3) adopt different open positions during the discharge cycle.

7. Product discharge control device for a form-fill-seal machine according to claim 6, wherein said discharge control elements (3) adopt a given first open position and then a more open position during the discharge cycle.

8. Product discharge control device for a form-fill-seal machine according to claim 1, wherein said motor (7) is a servomotor (7).

* * * * *